US006582517B2

(12) United States Patent
Volontéet al.

(10) Patent No.: US 6,582,517 B2
(45) Date of Patent: Jun. 24, 2003

(54) COMPARTMENT FOR POWDER COATING OF WORKPIECES

(75) Inventors: Armando Volonté, Valmadrera (IT); Christoph Keller, Hauptwil (CH); Horst Adams, Alstätten (CH)

(73) Assignee: Wagner International AG, Alstatten (CH)

( * ) Notice: Subject to any disclaimer, the term of this patent is extended or adjusted under 35 U.S.C. 154(b) by 137 days.

(21) Appl. No.: 09/757,366

(22) Filed: Jan. 8, 2001

(65) Prior Publication Data

US 2001/0020445 A1 Sep. 13, 2001

(30) Foreign Application Priority Data

Jan. 25, 2000 (IT) ..... MI2000A0091

(51) Int. Cl.[7] ..... B05C 15/00; B05C 19/00

(52) U.S. Cl. ..... 118/309; 118/308; 118/326; 454/50

(58) Field of Search ..... 118/309, 308, 118/326; 454/50, 53; 427/180

(56) References Cited

U.S. PATENT DOCUMENTS 4,715,314 A * 12/1987 Ramseier et al. ..... 118/326
5,680,670 A * 10/1997 Adams et al. ..... 15/302
5,690,995 A * 11/1997 Fischli et al. ..... 118/309

FOREIGN PATENT DOCUMENTS

EP 0 200 681 B1 4/1986
EP 0 727 258 B1 8/1995

* cited by examiner

*Primary Examiner*—Richard Crispino
*Assistant Examiner*—Y. T. Tadesse
(74) *Attorney, Agent, or Firm*—Fenwick & West LLP

(57) ABSTRACT

A compartment for powder coating of workpieces (20) which is simple in structure, cost effective, and easy to clean comprises a floor (32, 40), two sidewalls (2, 4), and two end walls (10, 12) at least one (12) of which has a door opening (16) for entry and/or exit of the workpieces (20). Two oblique walls (22, 24) are arranged symmetrically inclined with respect to each other at the inside surfaces of the sidewalls (2, 4) in the lower corner regions of the compartment, so that, together with the corner regions, they define a suction channel (34, 36) each, and with their lower edges they form suction gaps (s). The walkable floor (32) may be embodied by a stationary plate or a discharge belt. The oblique walls (22, 24) can be tilted up against or removed from the inside surfaces of the sidewalls (2, 4) for cleaning purposes.

19 Claims, 7 Drawing Sheets

COMPARTMENT FOR POWDER COATING OF WORKPIECES

FIELD OF THE INVENTION

The instant invention relates to a compartment for powder coating of workpieces, comprising a floor, two sidewalls, two end walls at least one of which has a door opening for entry and/or exit of the workpieces, a ceiling, and a suction system outside of the compartment.

BACKGROUND OF THE INVENTION

Workpieces usually are introduced into such compartments by a conveyor means and then coated with powder. Not all the powder supplied by the applicator devices to the workpieces actually deposits on the workpieces. Instead, the major part of this so-called excess powder settles on the compartment floor.

It is known to remove excess powder from the compartment by constructing the lower part of the compartment of sidewalls which are inclined in V shape with respect to each other, with a suction aperture provided at the lowest point thereof through which the powder slipping down along the oblique sidewalls is sucked off by means of a fan. As it is not possible to walk into such a compartment it is very difficult to clean it. Manual cleaning, especially of the suction channel disposed below the suction aperture practically is excluded (see for example, EP200681B1).

To overcome that, it has been proposed to design the floor of the compartment as a walkable discharge belt by which the accumulated excess powder is conveyed to a suction aperture at the end wall. Slots are provided at either side of the discharge belt outside of the two lower corner regions of the compartment and these slots communicate with lateral suction channels for recovery of the powder which a cleaning device blows off the walls of the compartment (see, for example, EP727 258B1). True, the floor constituted by the discharge belt is walkable and the walls of the compartment can be cleaned by a pneumatic cleaning device which is specifically provided for this purpose and movable through the compartment. But access to the suction channels located outside of the compartment for manual or mechanical cleaning is difficult. The discharge belt must be cleaned separately outside of the compartment. All this leads to an expensive structure.

SUMMARY OF THE INVENTION

It is an object of the invention to provide a compartment of the kind specified initially which is simple in structure, permits perfect removal of excess powder by suction and is easy to clean, including the suction channel.

A compartment according to the invention has a walkable floor embodied either by a stationary plate or a discharge belt. At least one but preferably two suction channels are integrated in the two lower corner regions of the compartment by the oblique walls according to the invention. These oblique walls preferably are hingedly connected to the inside surfaces of the sidewalls so that, for cleaning, they either can be tilted against the vertical inside surfaces of the sidewalls or removed from the same. Moreover, the pivotable connection of the oblique walls at the inside surfaces of the sidewalls permits easy adjustment of the gap widths of the suction gaps which are defined between the lower edges of the oblique walls and the floor of the compartment.

In the case of the embodiment where the floor of the compartment is a discharge belt, any remaining excess powder not sucked off laterally is conveyed out of the compartment and separately removed by suction outside of the same.

A compartment according to the invention is very cost effective due to its simple structure and the infrequent need for uncomplicated cleaning. The invention can be applied with particular advantage also where compartments are long.

Further advantageous modifications of the invention are covered by the dependent claims.

BRIEF DESCRIPTION OF THE DRAWING

The invention will be described further, by way of example, with reference to the accompanying drawings, in which.

DESCRIPTION OF THE PREFERRED EMBODIMENTS

Figure 1:
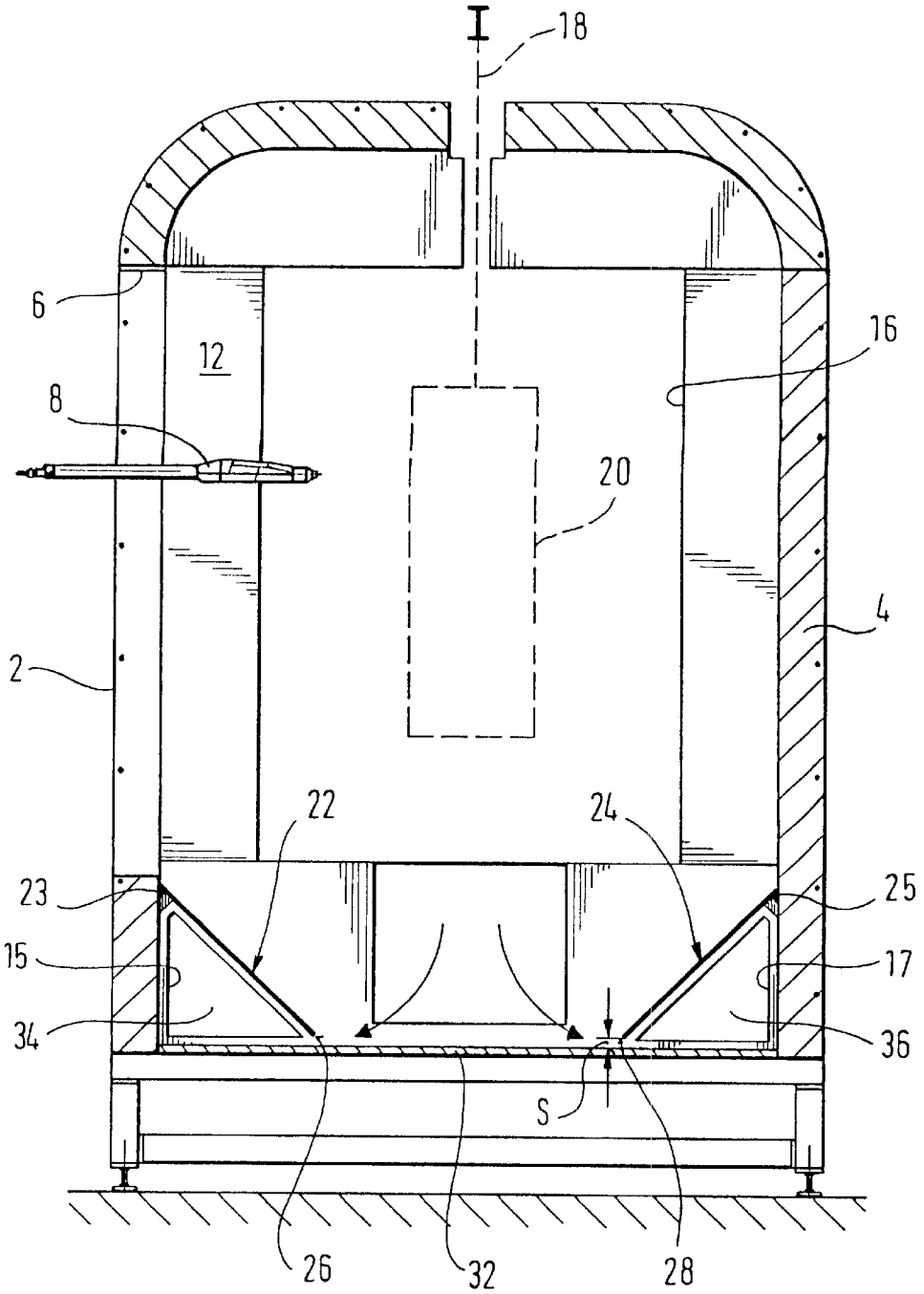
FIG. 1 is a cross sectional elevation of a first embodiment of a compartment according to the invention having a stationary floor.

The embodiments of the compartment illustrated in FIGS. 1 to 5 have the following features in common:

- two vertical sidewalls 2, 4 with apertures 6 and powder application devices 8 extending through them;
- two end walls 10, 12 with door openings 14, 16, one of the door openings 14 serving for entry and the other door opening 16 serving for exit of workpieces 20 which are conveyed along a conveyor line 18;
- oblique walls 22, 24, symmetrically inclined with respect to each other, which are hingedly connected to or loosely suspended from pivot locations 23, 25 at the inside surfaces of the sidewalls 2, 4 and have lower edges 26, 28;
- two suction channels 34, 36, each defined by the bottom surface of an oblique wall 22, 24, the lower corner region of the corresponding sidewall 2, 4, and the bottom area of the floor 32 below the oblique wall;
- two openings 15, 17 in the end wall 16 at the outlet end connecting the respective suction channel 34, 36 to a hood 11, 41 mounted at the outside for connection to an external suction system.

The pivot locations 23, 25 may be embodied by horizontal hinge axes about which the oblique walls 22, 24 can be tilted upwards against the sidewalls 2, 4.

Figure 2:
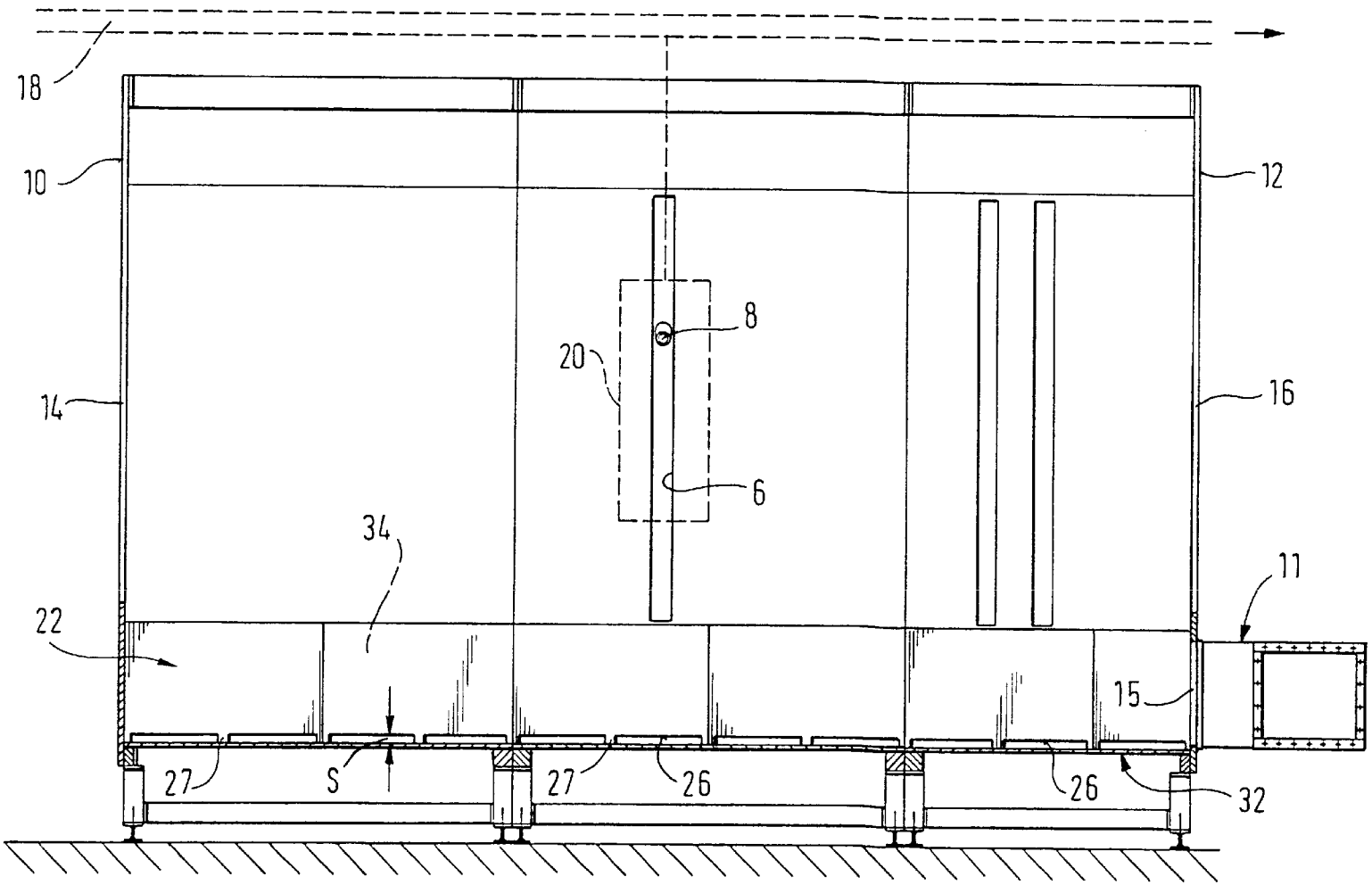
FIG. 2 is a longitudinal sectional elevation of the compartment shown in FIG. 1.
Figure 3:
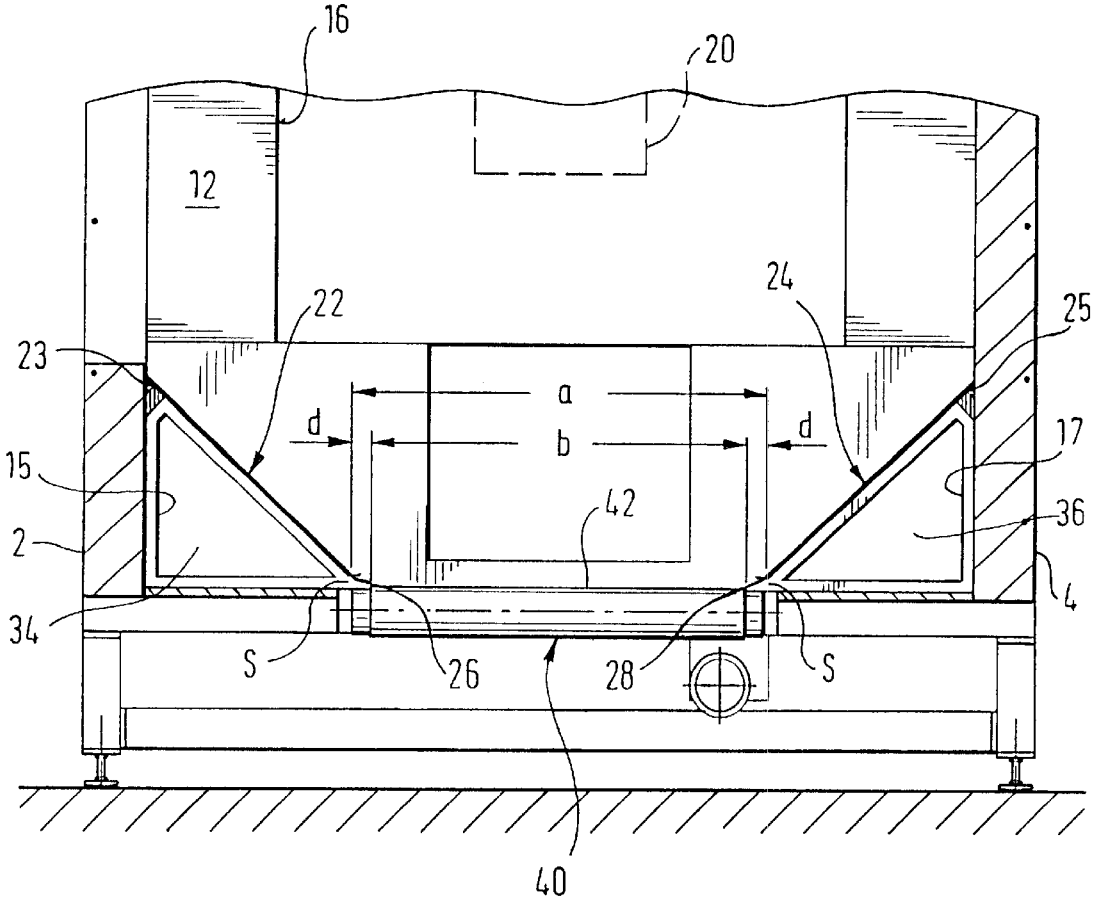
FIG. 3 is a part cross sectional elevation of a second embodiment of a compartment according to the invention having a narrow discharge belt at the bottom of the compartment.

In the embodiments shown in FIGS. 1 and 3 the oblique walls 22, 24 include fins 27 (FIG. 2) projecting downwardly from the lower edges and resting on a stationary floor 32 of the compartment. As may be seen in FIG. 2, the fins 27 are evenly spaced over the full length of the compartment so that a gap of constant gap width s is defined between the lower edges 26, 28 and the floor 32 of the compartment. Excess powder which has deposited on the floor 32 can be sucked sideways through this gap from the interior of the compartment into a suction channel 34, 36 which is defined by the bottom surface of the respective oblique wall 22, 24, the lower part of the inner surface of the sidewall 2, 4, and the floor 32 in the region of the lower corner.

Alternatively, the fins 27 may extend upwardly from the floor 32 and support the lower edges 26, 28 of the oblique walls 22, 24.

In the embodiment according to FIGS. 1 and 2 a single hood 11 is provided outside of the compartment, and the suction channels 34, 36 open into it through the two openings 15, 17. Alternatively, separate channels outside of the compartment may be connected to the two openings 15, 17 and be united at a distance from the same to form a common external suction channel (not shown).

The embodiment according to FIG. 3 differs from the one shown in FIGS. 1 and 2 in that a narrow discharge belt 40 is arranged in the area between the lower edges 26, 28 of the oblique walls 22, 24. The discharge belt 40 is adapted to be driven in the direction towards the door opening 16 provided in the end wall at the exit end. The discharge belt moves through the end wall opening 16, its upper run 42 moving below the hood 41 mounted on this wall and passing underneath a slit-like opening 44 in the hood 41. In the embodiment according to FIGS. 3 to 5 the hood 41 covers the full width of the compartment, communicating at either side through the respective openings 15, 17 of the suction channels 34, 36 and at the bottom through the slit-like opening 44 with the compartment. In this manner excess powder can be sucked even more effectively from the interior of the compartment than with the embodiment according to FIG. 1.

It is important with the embodiment shown in FIG. 3 that a minimum spacing d be observed between the lateral edges of the discharge belt 40 and the lower edges 26, 28 of the oblique walls 22, 24. In practice this spacing may be 5 cm. The spacing is needed in order to create favorable flow conditions at the suction gap s.

Figure 4:
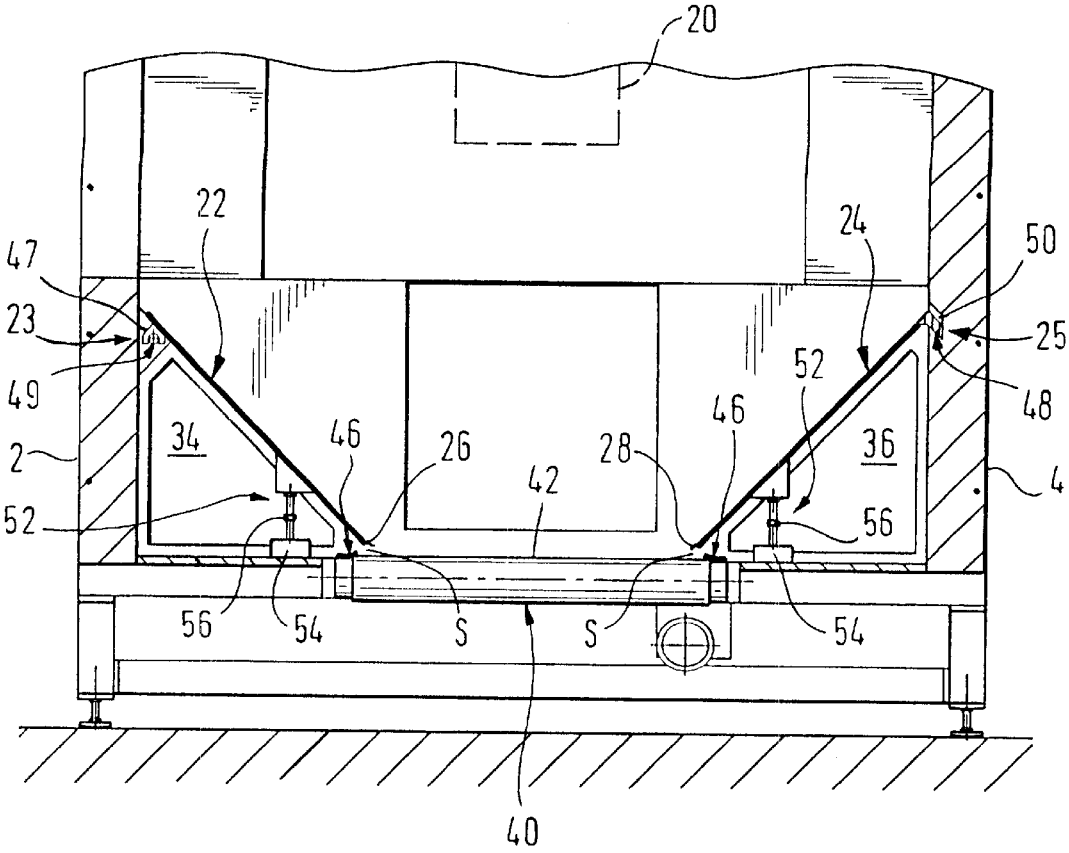
FIG. 4 is a part cross sectional elevation similar to FIG. 3 of a third embodiment of the invention having a wide discharge belt at the floor of the compartment.
Figure 5:
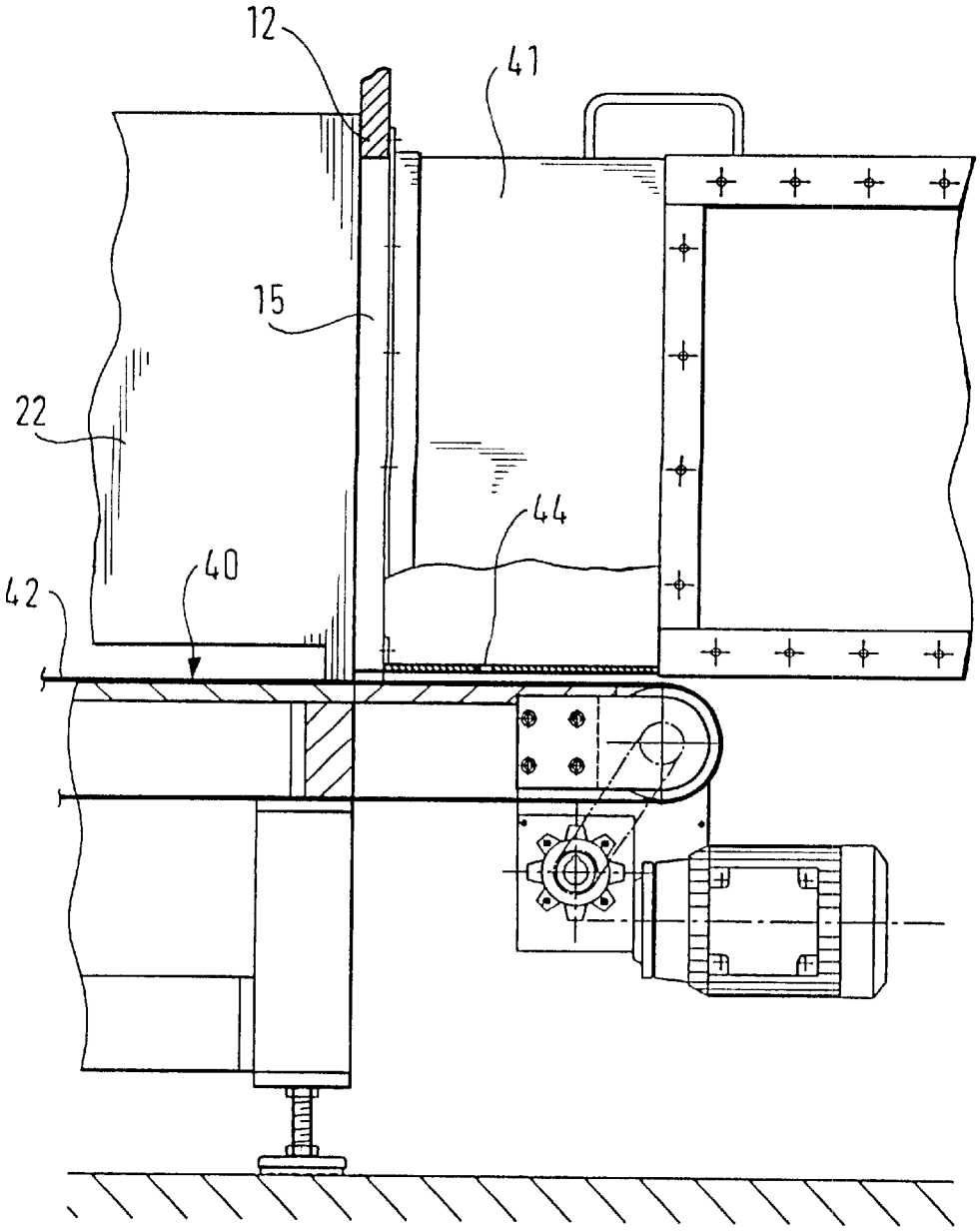
FIG. 5 is a part longitudinal sectional elevation of compartments as shown in FIG. 3 or FIG. 4 and a detail at the exit end of the discharge belt outside of the compartment.

The embodiment shown in FIG. 4 likewise comprises a discharge belt 40 with an upper run 42. The sectional elevation of FIG. 5 is applicable also to the embodiment according to FIG. 4. In other words, the arrangement of the discharge belt 41 below the hood 41 with its slit-like opening 44 is the same.

What is different is that the width of the discharge belt 40 extends beyond the lower edges 26, 28 of the oblique walls 22, 24 at both sides. The margins along the sides of the wide discharge belt 40 according to FIG. 4 both are covered by sealing strips 46 of an elastomeric material so that favorable flow conditions for suction may be obtained. FIG. 4 illustrates two further peculiarities regarding the oblique walls 22, 24 according to the invention. These may be provided as alternatives also in the embodiments shown in FIGS. 1 to 3.

Here, the oblique walls are not firmly hinged to the inside surfaces of the vertical sidewalls 2, 4 but instead in such a way that they may be taken off. That may be achieved by hooks 47, 48 which are mounted at the upper ends of the oblique walls 22, 24 and which, in assembled state, engage horizontal bars 49 fixed to the sidewalls 2, 4 (shown at the left-hand side in FIG. 4) or horizontal longitudinal grooves formed in the sidewalls (shown at the right-hand side in FIG. 4).

Thus the oblique walls 22, 24 may be removed simply by lifting their hooks out of engagement when it is desired to clean the walls of the compartment.

Another peculiar feature is that the oblique walls 22, 24 are provided with adjustment devices 52 by means of which the inclination of the oblique walls 22, 24 with respect to the pivot locations 23, 25 may be varied so as to adjust the gap width s. In the embodiment shown, the adjustment devices 52 are embodied by vertical adjustment columns 54 which are split and the length of which is variable manually by turning adjustment nuts 56.

Alternatively, the adjustment columns may be formed by mechanically, hydraulically, or pneumatically adjustable telescopes.

With all the embodiments, it is possible to walk into the compartment, in the case of the embodiment shown in FIGS. 1 and 2 the stationary floor 32 is walkable and in the case of the embodiments according to FIGS. 3 to 5 it is the discharge belt 40.

For cleaning the compartment, the oblique walls 22, 24 either are tilted upwards (embodiment of FIGS. 1 to 3) or removed (embodiment according to FIG. 4). Thus it is easy to clean both the interior of the compartment and also the suction channels 34, 36.

The invention can be carried out also with but one oblique wall 22 or 24 in one of the lower corner regions of the compartment.

The invention is not restricted to an arrangement comprising two door openings 14, 16 at the two ends. Instead, it is applicable also to an embodiment provided with a single door through which the workpieces 20 are transported into the compartment for coating and out again in the opposite direction after the coating is finished.

In another embodiment of the invention, which the workpieces are introduced from above into the compartment and taken out after having been coated. In that case the door openings 14, 16 in the end walls 10, 12 may be dispensed with.

Figure 6:
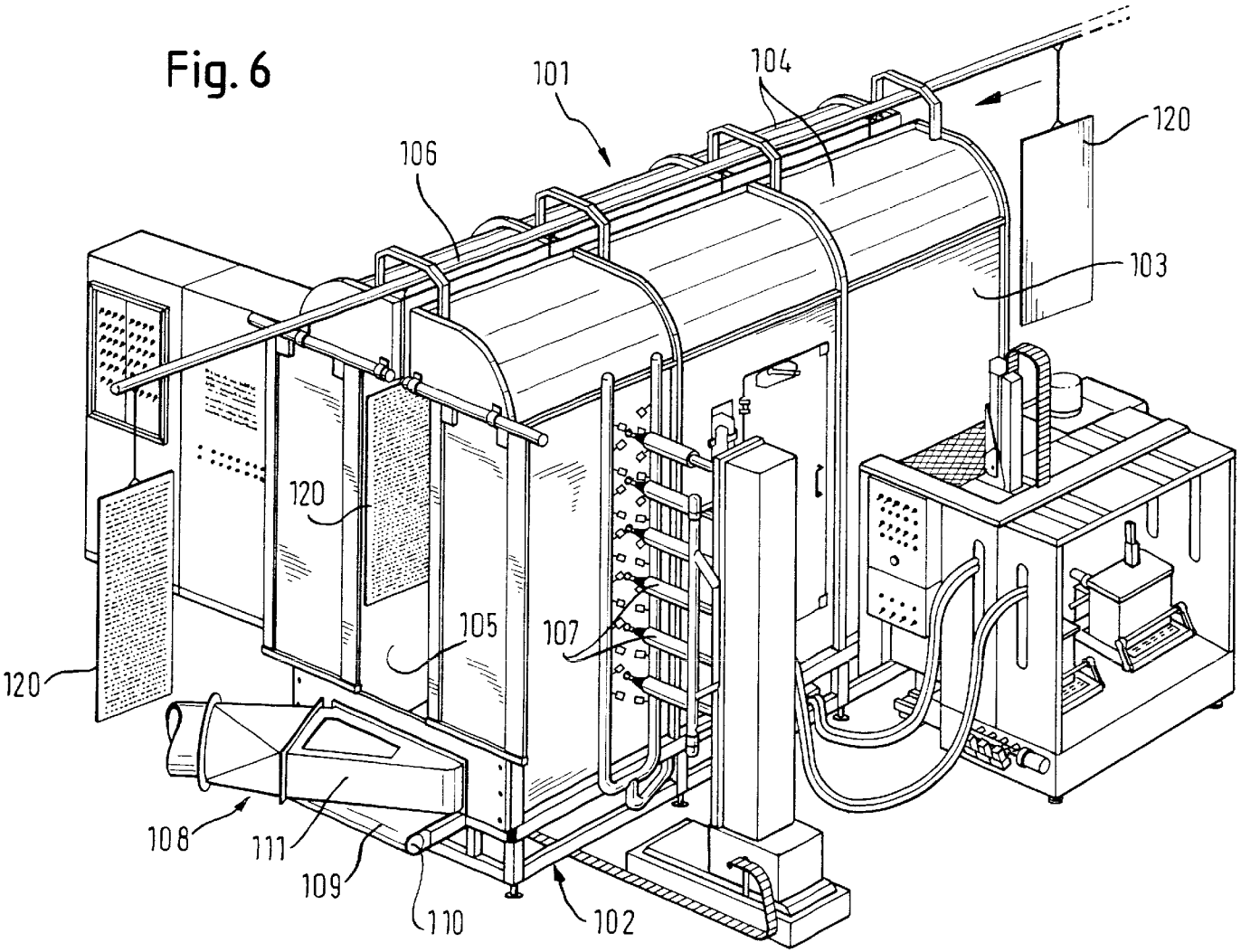
FIG. 6 is a perspective view, at an angle from the front and from the top, of an actual compartment structure of the type shown in FIGS. 3 and 5.

In a compartment structure built as illustrated in FIG. 6 the compartment 101 has a floor 102, sidewalls 103, and a divided ceiling 104. The end walls are formed with corresponding door openings, one for entry of workpieces to be coated (not to be seen in FIG. 6) and one, designated 105, for coated workpieces 120 to leave the compartment. The workpieces 120 are moved by a conveyor means 106 of conventional kind. Coloring powder is sprayed from a vertical row of electrostatic spray guns 107 through a vertical longitudinal opening into the interior of the compartment. Any excess powder which does not reach the workpiece 120 will drop on a discharge belt 109 located above the stationary floor 102 from which it will then be withdrawn by a suction system generally indicated 108. The discharge belt 109 extends out of the compartment below a hood 111 connected to the suction system 108. Below the hood, the discharge belt can be cleaned by suction through a slit-like opening formed in the bottom of the hood. This is where the discharge belt 109 is deflected by a roller pair 110 so as to return into the compartment.

Figure 7:
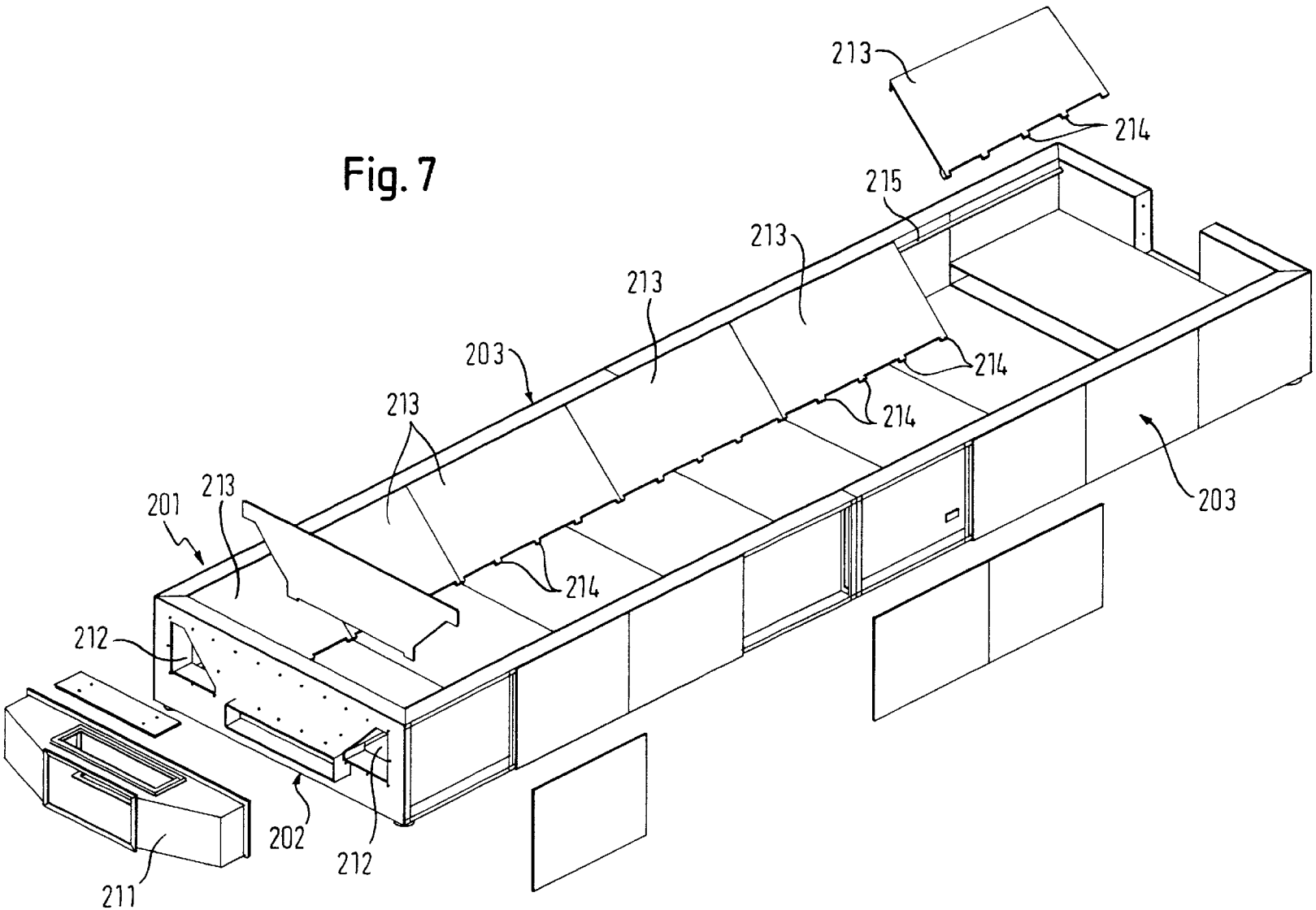
FIG. 7 is a view similar to FIG. 6, looking on the stationary floor, with the upper part omitted, of another actual compartment structure of the type shown in FIGS. 1 and 2.

In the case of the modified compartment 201 illustrated in FIG. 7, a hood 211 is provided at the outlet end for connection to a suction system. The hood 211 communicates with a pair of suction channels 212 formed on the stationary floor of the compartment along both sidewalls 203. The suction channels 212 each are defined by the floor 202, one of the vertical sidewalls 203, and a series of inclined plates 213 which are provided along their lower edges with fins or supporting feet 214.

By their fins 214 the plates 213 rest on the floor 202 of the compartment, while their upper edges are supported on the sidewalls 203, preferably by engaging a guide rail 215 which is fixed to the sidewall and has a profile such that it can receive a row of hooks (not shown in FIG. 7) at the upper edge of the plates 213, or the like. The fins 214 which rest on the floor 202 maintain the lower edges of the plates 213 at a slightly higher level, whereby a suction gap is formed along the full length of the compartment. The excess powder which has accumulated on the floor is sucked off through this gap. The suction gap has a gap width which preferably increases continuously in longitudinal direction from the exit end (left-hand side in FIGS. 6 and 7) to the entry end (right-hand side in FIGS. 6 and 7) in order to balance with ambient pressure the pressure difference of the suction air which decreases towards the entry end, thereby making sure that the suction effect is uniform throughout the length of the compartment.

During the coating process excess powder first slides down the vertical sidewalls which are painted with an antiadhesive varnish, then slips along the plates 213, and deposits on the floor. The suction air entrains the excess powder from the floor and the powder, having been sucked through the lower gap, reaches the hood 211 and then is passed on to conventional separating and collecting stations. In this manner the floor 202 of the compartment is constantly kept clean.

The hood 111, 211 may communicate directly with the suction channel 212, aspiration of air taking place from one end thereof.

The compartment shown in FIG. 7 has a stationary floor 202 on which excess powder deposits.

The plates 213 may be mounted on the guide rail 215 so as to be tiltable. An especially advantageous solution provides for the plates 213 simply to rest on the floor 202 and lean with their upper ends against the sidewall 203 of the compartment so that they can be removed with ease. This arrangement permits effective and very rapid cleaning both of the compartment and the plates, whereby procedures during a change of powder are expedited enormously.

A conduit of variable cross section may be provided at either side of the floor of the compartment, comprising air suction holes distributed along their lengths and communicating with the suction channel. With this solution the cross section of the conduit in axial direction is preferred to be variable to compensate pressure losses during movement of the air and ensure substantially uniform suction throughout the length of the compartment. Alternatively, the conduit may have a uniform cross section, while the suction holes are of variable diameter.

What is claimed is:

1. A compartment for powder coating of workpieces (20), comprising a walkable floor (32, 40), two sidewalls (2, 4), two end walls (10, 12) at least one of which has a door opening (14, 16) for entry and/or exit of the workpieces, and a suction system outside of the compartment, an oblique wall (22, 24) being arranged between the inside surface of at least one sidewall (2, 4) and the floor, defining a suction channel (34, 36) together with the sidewall (2, 4) and the floor in a lower corner region of the compartment and its lower edge (26, 28) said oblique wall maintaining a defined spacing from the floor (32, 40) over at least part of the length of the compartment so as to form a suction gap(s) through which any excess powder deposited on the floor can be sucked off into the suction channel (34, 36).

2. The compartment as claimed in claim 1, characterized in that the floor comprises at least one substantially horizontal stationary plate (32).

3. The compartment as claimed in claim 1, characterized in that the floor (32) comprises a discharge belt (40).

4. The compartment as claimed in claim 3, characterized in that the discharge belt (40) is adapted to be driven in the direction towards an end wall (12) to which the suction system is connected.

5. The compartment as claimed in claim 1, characterized in that two oblique walls (22, 24) are provided which are inclined symmetrically with respect to each other in the two lower corner regions of the compartment.

6. The compartment as claimed in claim 3, characterized in that the width (b) of the discharge belt (40) is less than the spacing (a) between the lower edges (26, 28) of the two oblique walls (22, 24).

7. The compartment as claimed in claim 6, characterized in that a minimum spacing (d), being in particular no less than 5 cm, is provided between each lateral edge of the discharge belt (40) and the respective lower ledge (26, 28) of the corresponding oblique wall.

8. The compartment as claimed in claim 5, characterized in that, at both sides, the discharge belt (40) projects beyond the lower ledges (26, 28) of the oblique walls (22, 24).

9. The compartment as claimed in claim 8, characterized in that the lateral edges of the discharge belt are sealed by sealing strips (46).

10. The compartment as claimed in claim 1, characterized in that the or each suction channel (34, 36) communicates through an opening (15, 17) in one of the two end walls with a hood (11, 41) connected to the suction system.

11. The compartment as claimed in claim 10, characterized in that the hood (41) is located above the discharge belt (40) and has a suction opening (44) which sweeps across the discharge belt.

12. The compartment as claimed in claim 1, characterized in that the gap width of the or each suction gap(s) is adjustable by means of an adjustment device (52).

13. The compartment as claimed in claim 12, characterized in that the adjustment device is operable manually.

14. The compartment as claimed in claim 1, characterized in that the oblique walls (22, 24) are pivotably connected to the inside surfaces of the sidewalls and adapted to be tilted against the vertical inside surfaces of the sidewalls (2, 4).

15. The compartment as claimed in claim 1, characterized in that the oblique walls (22, 24) are suspended from the inside surfaces of the sidewalls (2, 4) and adapted to be taken off from the same.

16. The compartment as claimed in claim 1, characterized in that the gap width of the suction gap(s) increases from the end wall (12) of the compartment to which the suction system is connected in the direction towards the opposite end wall (10).

17. A compartment for powder coating workpieces comprising: a floor including a substantially horizontal stationary plate and side walls and end walls forming the compartment, and including an access port for passage therethrough of the workpieces; a suction channel being delimited by a portion of the floor, one side wall and an oblique wall, a lower edge of the oblique wall being spaced from the floor at least over a portion of the length thereof to form a suction gap through which excess powder supplied for coating workpieces is suctioned from the compartment.

18. A compartment for powder coating workpieces comprising: a floor including a movable, continuous belt and side walls and end walls forming the compartment, and including an access port for passage therethrough of the workpieces; a suction channel being delimited by a portion of the floor, one side wall and an oblique wall, a lower edge of the oblique wall being spaced from the floor at least over a portion of the length thereof to form a suction gap through which excess powder supplied for coating workpieces is suctioned from the compartment.

19. The compartment according to claim 18 in which the belt is movable within the compartment toward an end wall including a suction gap thereat with the suction channel through which powder on the belt is suctioned from the compartment.

* * * * *